United States Patent [19]

Abels et al.

[11] 4,125,199

[45] Nov. 14, 1978

[54] LATERAL-SHIFT DEVICE FOR FORK-LIFT VEHICLES

[75] Inventors: Theodor Abels, Aschaffenburg-Nilkheim; Manfred Reissl, Radheim; Willi Müller, Goldbach, all of Germany

[73] Assignee: Linde Aktiengesellschaft, Höllriegelskreuth, Germany

[21] Appl. No.: 821,475

[22] Filed: Aug. 3, 1977

Related U.S. Application Data

[63] Continuation of Ser. No. 638,157, Dec. 5, 1975, abandoned, which is a continuation of Ser. No. 459,048, Apr. 8, 1974, abandoned.

[30] Foreign Application Priority Data

Apr. 9, 1973 [DE] Fed. Rep. of Germany ..... 2317758
Jul. 18, 1973 [DE] Fed. Rep. of Germany ..... 2336597
Aug. 3, 1973 [DE] Fed. Rep. of Germany ..... 2339431

[51] Int. Cl.[2] ..... B66F 9/14
[52] U.S. Cl. ..... 214/730; 92/151
[58] Field of Search ..... 214/730, 731, 650–653; 92/51, 150, 151, 165 R

[56] References Cited

U.S. PATENT DOCUMENTS

| | | | |
|---|---|---|---|
| 2,193,497 | 3/1940 | Spire | 92/151 |
| 2,820,562 | 1/1958 | Schenkelberger | 214/730 |
| 2,822,101 | 2/1958 | Schenkelberger | 214/730 |
| 2,847,138 | 8/1958 | Bockofen et al. | 214/730 |
| 2,920,775 | 1/1960 | Schenkelberger | 214/730 |
| 3,356,241 | 12/1967 | Varilek | 214/731 |
| 3,460,700 | 8/1969 | Kroupa | 214/730 |
| 3,819,078 | 6/1974 | Walsh | 214/730 |

FOREIGN PATENT DOCUMENTS

| | | | |
|---|---|---|---|
| 1,336,551 | 11/1973 | United Kingdom | 214/730 |

*Primary Examiner*—Lawrence J. Oresky
*Attorney, Agent, or Firm*—Karl F. Ross

[57] ABSTRACT

A lateral-shift device for the prongs of a fork-lift vehicle in which the fork carrier and prong-support device is laterally shiftable by a mechanism at least in part recessed in the front face of the carrier on which the fork is vertically displaceable such that the forward portions of the fork support member does not extend sufficiently forwardly to materially shift the weight of the system in this direction.

3 Claims, 13 Drawing Figures

FIG. 7
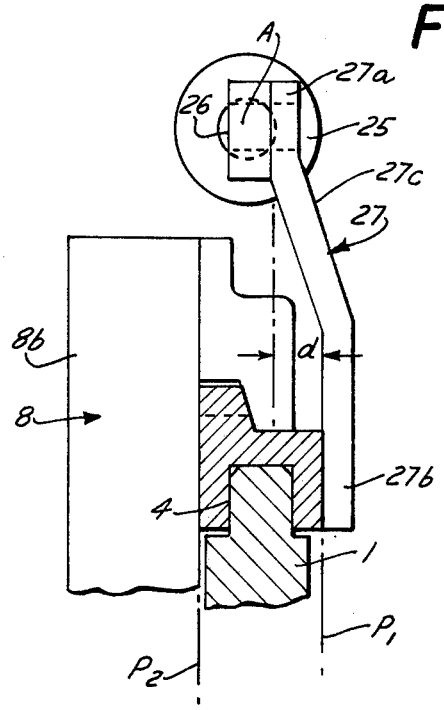
FIG. 9
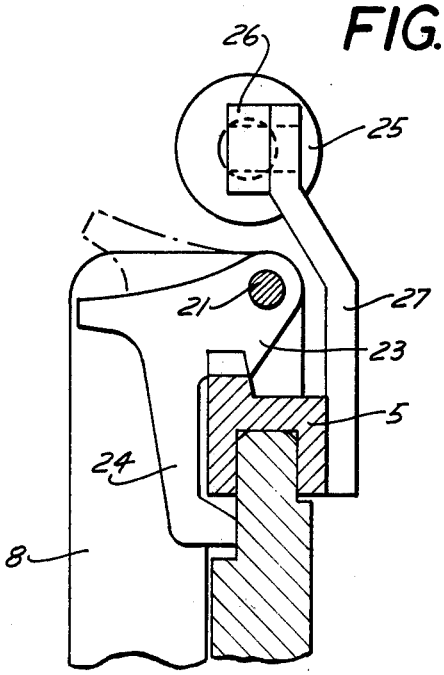
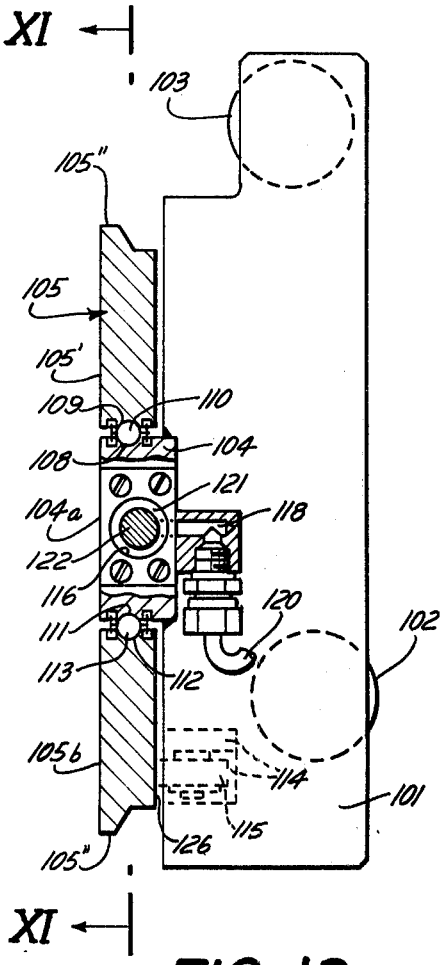
FIG 12

LATERAL-SHIFT DEVICE FOR FORK-LIFT VEHICLES

This is a continuation of application Ser. No. 638,157 filed Dec. 5, 1975, now abandoned which is a continuation of Ser. No. 459,048 filed 4/8/74, now abandoned.

FIELD OF THE INVENTION

The present invention relates to fork-lift vehicles and, more particularly, to industrial vehicles for use in warehouse areas or structures, loading platforms, yards and like for the transportation of palletted loads and the like by engagement from below with forwardly projecting prongs of a fork.

BACKGROUND OF THE INVENTION

Manually displaced and automotive industrial driven by electrical or internal combustion power have been provided heretofore with an upright framework upon which a prong support is vertically displaceable, a pair of prongs forming a fork, projecting forwardly of this carrier to engage beneath a load to permit the same to be lifted on the fork from a stack or from the floor, to be displaced with the vehicle, and to be lowered onto the floor for a stack. In general such loads are so-called palletted loads in which one or more articles are placed upon or secured to a pallet of wood or other material having spaces beneath the load-receiving platform into which the prongs of the fork may extend.

The fork-carrier member is vertically displaceable from a position in which the prongs substantially contact the floor to a relatively high position enabling the apparatus to be used for the stacking of loads to considerable heights.

Such apparatus has been provided heretofore with means for laterally shifting the prongs relative to the upright frame, e.g. when it is desired in lowering the load, to correct the lateral position thereof without maneuvering the entire vehicle.

Such operations are desirable in a large number of cases, e.g. when loads are to be stacked one against another or against a wall toward which the vehicle cannot be more closely maneuvered. The lateral displacement of the prongs is also desirable when the latter are in an elevated position, a lowered position for any intermediate positions to permit insertion of misaligned prongs into the spaces beneath the load-carrying platform.

Furthermore, when a lateral force must be applied to the load after it has been stacked, e.g. to corrent the position of stacked loads, the lateral displaceability of the prongs is of advantage.

Conventional lateral-shift devices for this purpose generally comprise means mounted ahead of the fork-carrier to displace the prongs and hence provide relatively massive structure at a location more forward of the fork carrier, thereby shifting the center of gravity of the vehicle forwardly and disposing the load at a greater distance ahead of the front axle of the vehicle. This has the disadvantage that, together with the increased weight of the lateral-shift device, that the load-carrying capacity of the vehicle is diminished. In many cases, the lateral shift device is hydraulically operable and a connection must be made between the hydraulically driven parts and the remainder of the vehicle by flexible ducts which are susceptible to breakage in the rigorous use to which such vehicles are subject.

OBJECTS OF THE INVENTION

It is the principal object of the present invention to provide a fork-lift vehicle whereby the advantages of a lateral shifting of the fork are obtained without the disadvantage enumerated.

It is another object of the invention to provide a lateral shift device for the fork lift or like vehicle in such manner that the reduction in the load-carrying capacity of the vehicle, resulting from the inclusion of such a device, is diminished.

Still another object of the invention is to provide a lateral shift device for the purposes described which has a low mass and does not materially shift and add mass forwardly of the normal fork-carrier so that the center of gravity of the added mass is as close as possible to the lifting frame.

SUMMARY OF THE INVENTION

These objects and others which will become apparent hereinafter are attained, in accordance with the present invention, in a fork-lift vehicle comprising a vehicle body, a lifting frame at a forward end of this body, (see application Ser. No. 375,008, filed June 29, 1973) a fork carrier vertically displaceable along this frame and a pair of prongs mounted on the fork carrier and projecting forwardly therefrom, the system further including a laterally shift device which at least in major part lies in the vertical plane of the front face of the lifting frame or proximal thereto whereby the forwardmost portions of the lateral shift device do not project beyond or project only to a minor extent beyond the forward face of the fork carrier. In this manner we are able to achieve a reduction in the forward dimensions of the dimensions of the device and to limit or prevent any additional mass of the lateral shift device from shifting the center of gravity of a load carried by the prongs in the forward direction.

According to another feature of the invention, a portion of the fork carrier can be constituted in part as a shiftable support member.

An important feature of the invention resides in incorporating the fluid-responsive actuating cylinder for the radial shaft arrangement between the vertical planes which define the front and rear faces of the fork carrier. Of course, it is most advantageous from the point of view of weight distribution to include the hydraulic actuating cylinder wholly between the planes of these faces and therefore to incorporate the hydraulic device in a recess of the fork carrier. However, the cylinder may also be disposed above or below the fork carrier, also with at least its axis in the space between these two planes.

According to another feature of the invention, moreover, the upper edge of the fork carrier is provided with a load-bearing guide rail upon which the fork may be mounted with at least some degree of freedom of movement in the horizontal direction. In this manner, each of the fork members are always, with the same distance from one another, shiftable in the same direction. It is also possible with this system to modify the spacing of the two forks, i.e. to displace one fork member relative to the other, and to displace either fork member in either direction independently of the other. This permits the system to adjust to various spacings of the socket of a load into which the fork members is to be inserted. The system of the invention is also able to accommodate joint movement of the fork members in either direction and simultaneous variation in the spacing of the fork members.

When it is desirable to modify the spacing of the fork members from one another, we may use a chain drive in which case both fork members may be connected to the same pass of the chain for joint movement in the same direction, or to the opposite passes of the same for counter-movement.

Preferably both fork members bear upon a common support which itself is shiftable upon a load-carrying rail of the fork carrier. The fork carrier is provided with this latter rail at least along its upper edge as noted but preferably along its lower edge as well. Since a canting of the fork generates a force moment upon the fork carrier tending to bring the upper portion forwardly and the lower portion rearwardly we have found that it is advantageous to support the lower portion with one or more rollers against a supporting surface. Such rollers may also be provided between the fork and the fork carrier.

The upper support device can be provided with a guide rail having low-friction surfaces composed of a material with a low-coefficient of sliding friction such as a light metal (aluminum) or an alloy thereof or brass, can be made from steel and highly finished or polished or can be provided with a low-friction layer of a synthetic-resin such as polytetrafluoroethylene. Low-friction bodies, such as bearing balls or rollers can also be interposed between the relatively displaceable parts and, where balls are used, they may be received in a V-section race whose flanks are oriented for maximum effectiveness in force transfer.

Preferably, the upper and lower members are constituted as bars and are both provided with guide rails, the bars preferably being interconnected by lateral webs or webs lying behind the fork carrier, into a rigid frame. In the latter case, the actuating cylinder is preferably disposed in an opening or window in the frame and can be connected with a bent strap to an upper riding block or to both riding blocks. Preferably the actuating cylinder is disposed directly in the fork carrier and has pistons which bear directly upon lateral webs connecting the bars of the frame.

According to another feature of the invention, the fork may be provided with a pawl engageable in recesses spaced along the riding lock and having a finger preventing canting of the fork and limiting the play.

BRIEF DESCRIPTION OF THE DRAWING

The above and other objects, features and advantages of the present invention will become more readily apparent from the following description, reference being made to the accompanying drawing in which:

FIG. 7 is a detail view corresponding to FIG. 6 but showing an arrangement of the actuating cylinder which differs from that of FIGS. 1 and 5;

FIG. 9 is a view similar to FIG. 7 showing another embodiment of the invention utilizing a pawl or latch arrangement of the type previously shown in FIG. 6;

FIG. 12 is a cross-sectional view taken along the line XII—XII of FIG. 11.

SPECIFIC DESCRIPTION

Figure 8:
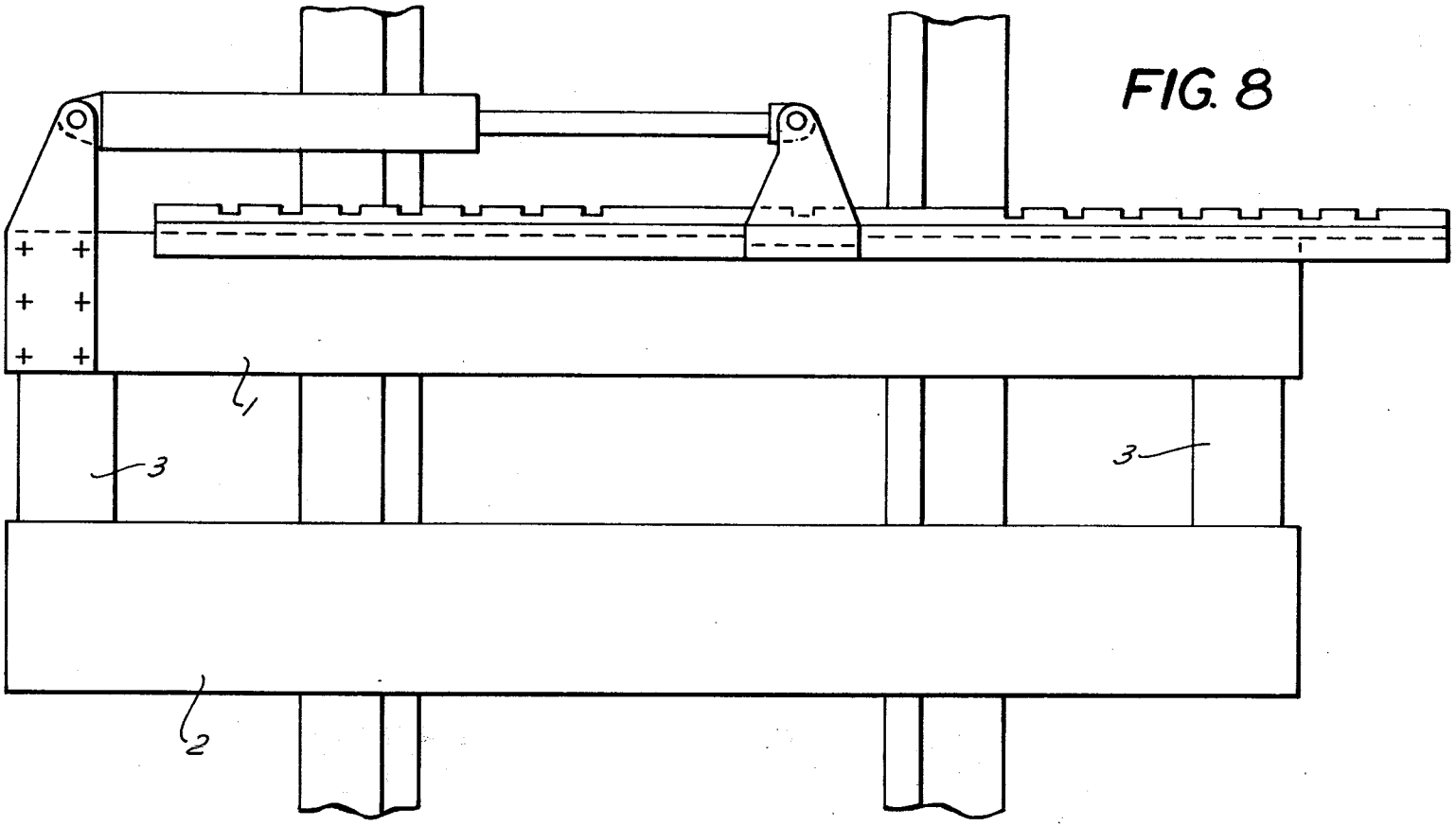
FIG. 8 is a front-elevational view of the system corresponding to FIG. 7.

The fork-carrier according to the present invention comprises an upper bar 1 and a lower bar 2 which are connected with vertical struts 3 to one another and are mounted on a carriage (not shown) which is vertically displaceable upon a lifting frame of a fork-lift vehicle which may be of the type described in the copending applications mentioned previously. The relationship of the lifting frame to the assembly has been shown in FIGS. 8–10 and also applies to the embodiment of FIGS. 1 and 5.

The upper edge of the prismatic upper bar 1 which is generally of the rectangular parallelepipedal configuration, is formed with a guide-rail 4 of rectangular cross-section, upon which a support member 5 of complementary configuration is guided. The support member 5 thus has a groove of rectangular cross-section which slidably receives the rail 5.

Member 5 is provided at its upper side with a trapezoidal cross-section flange 6 which is engaged by the hook 7 of the fork 8 whose prongs project horizontally as shown fragmentarily at **8*a***.

The underside of the lower bar 4 is formed with a trapezoidal-section flange 9 which is engaged by a hook 10 of the fork 8. The flanges 6 and 9 each have one inclined flank turned away from the fork 8 and paralleled by a correspondingly inclined flank of the hook 7 or 10 of the fork. The other flank of the trapezoidal section lies in a vertical plane substantially parallel to the upright portion **8*b* of the fork. The flanges 6 and 9** respectively converge upwardly and downwardly, i.e. in opposite directions.

In the space between the bars 1 and 2, we provide an actuating cylinder 11 whose piston rod 12 is connected by a bent strap 13 with the upper support member 5. The latter is adapted to carry the weight of the fork as will be apparent hereinafter, the hooks 9 and 10 merely limiting forward and rearward movement of the fork 8 with respect to the bars 1 and 2.

Figure 2:
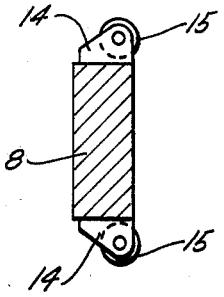
FIG. 2 is a plan view, in section, of a portion thereof.
Figure 3:
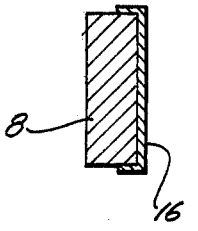
FIG. 3 is a view similar to FIG. 2 showing an alternative to the construction illustrated therein.

At its lower end, the upright portion **8*b* of the fork 8 is provided at each side with rollers 15 as can be seen in FIG. 2, the rollers being journaled about vertical axes in journal blocks or bearings 14 for rotation about vertical axes. The rollers 15 are generally barrel-shape, i.e. are defined by an outwardly converging curved-line generatrix corresponding to a circle segment. The guide rolls 15 bear against the forward face 2*a* of the bar 2**.

As an alternative to the rollers 15, a substantially frictionless lateral guidance of the fork 8 can be achieved by interposing between the rear face 8*c* of the upright member 8*b* of the fork, and a surface 2*a* of the lower bar 2, a low-friction bearing surface as represented at 16 or 17. Member 17 is a layer of low-friction highly polished metal, e.g. stainless steel or is a bearing metal such as white metal, or is a strip of sintered metal provided with a lubricant such as molybdenum disulfide. The strip 16 is fitted onto the upright member 8*b* of the fork and has flanges pressed around the sides thereof.

Figure 4:
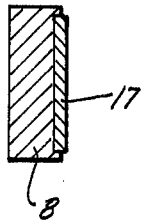
FIG. 4 is another view similar to FIG. 2 illustrating still another configuration performing the same function.

In the embodiment of FIG. 4, the bearing layer 17 is recessed in the face 8*c* of the upright member 8*b* of the fork and may consist of synthetic resin, e.g. polytetrafluoroethylene or a mass of soft material impregnated with a so-called self-lubricating substance such as graphite or molybdenum disulfide.

The cylinder 11 may be anchored upon the strut 3 so that extension of the cylinder will shift the fork 8 out of the plane of the paper and toward the viewer, i.e. to the right facing the front of the fork-like vehicle while retracting of the piston will shift the fork to the left, i.e. to a position below the plane of the paper. Where both prongs 8*a* of the fork are connected to a single upright 8*b* they will, of course, be moved simultaneously in the same direction by the mechanism illustrated in FIG. 1. Where, on the other hand, independent displacement of the fork prongs is desired, each prong 8*a* is provided with the respective upright 8*b* and the support member 5 thereof is connected with the cylinder rod of a respective cylinder, the cylinder being actuated sunchronously or independently to enable the prongs to move together in either direction or to move relative to one another in either direction.

Figure 5:
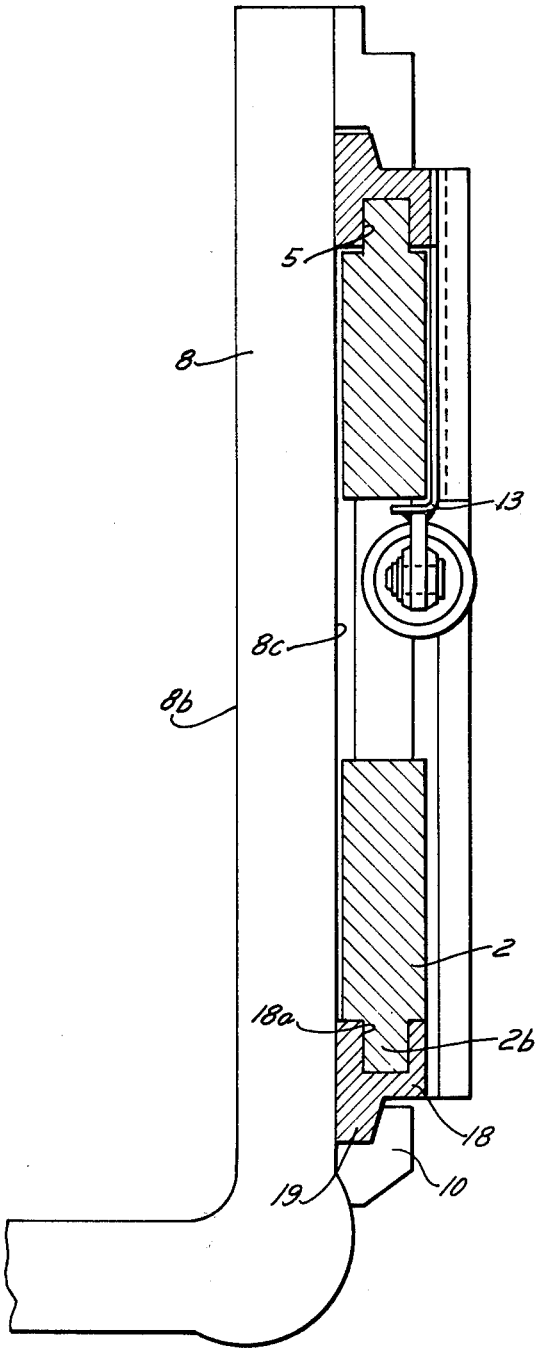
FIG. 5 is a view similar to FIG. 1 but illustrating another embodiment of the invention.

In the embodiment of FIG. 5, the lower edge of bar 2 also serves as a guide-rail upon which the guide block 18 is slidable. To this end, the bar 2 has a downwardly-projecting rail 2*b* of rectangular cross-section which is received within the groove 18*a* of complementary cross-section formed in the riding block 18. The latter, being entrained with the fork, has a flange 19 which is retained by the hook 10 against the surface 8*c* of the upright 8*b* of the fork 8. In addition, the riding block 18 is connected to the riding block 5 by vertical struts 20 to which the strap 13 may be anchored if desired. The riding block 5, as described in connection with FIG. 1, has a downwardly open groove 5*a* of rectangular cross-section in which the retangular section rail 4 projecting from the bar 1 is received.

The riding blocks 5 and 18, of which block 5 carries the load, together with struts 20 form a rigid frame which is vertically shiftable on the lifting frame as will be described in greater detail in connection with FIG. 10.

Figure 6:
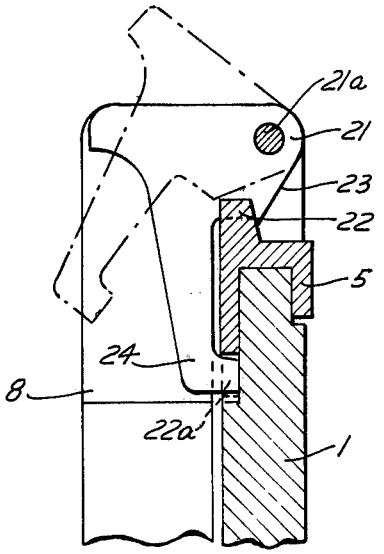
FIG. 6 is a detail view of a latch arrangement adapted to be used as an alternative to the guiding system of FIGS. 1 and 5.

FIG. 6 illustrates an embodiment of the invention wherein the load-carrying riding block 5, which is horizontally elongated, is provided with notches or recesses 22 in which a finger 23 of pawl 21 can be selectively received. The pawl 21 is pivoted at 21*a* upon the upper end of fork 8. When the pawl is in its solid line position, relative lateral displacement of the fork 8 and the riding block 5 is prevented. Finger 23 is, however, provided with a projection 24 which, at its lower end, is receivable with slight lateral play in a recess 22*a* of the riding block 5 so that a lateral tilting of the fork 8 is precluded. The pawl 21 may be swung out of engagement with the riding block 8 (broken line position) to permit relative lateral displacement of the fork and the riding block and thereby adjust the position of the fork relative to the riding block for any special application in which use of the lateral displacement device may be desirable. For example, when obstructions prevent the longitudinal axis of the vehicle from being aligned with the slots of a pallet to be lifted, the two fork prongs may be shifed to one end or the other of the riding block 5 whose further lateral displacement in this direction will shift the fork significantly out of line with the vehicle axis and permit it to lift the load. Thus, manual positioning of the fork relative to the riding block and locking the same against relative displacement thereafter greatly increases the versatility of the system.

Furthermore, the process can be simplified if the adjustment is carried out by resting the fork upon the ground, disengaging the latching pawl 21 and operating the cylinder 11 to shift the riding block relative to the fork until the desired relative positions are attained, whereupon the pawl is rotated counterclockwise (FIG. 6) to lock the fork relative to the riding block.

Figure 1:
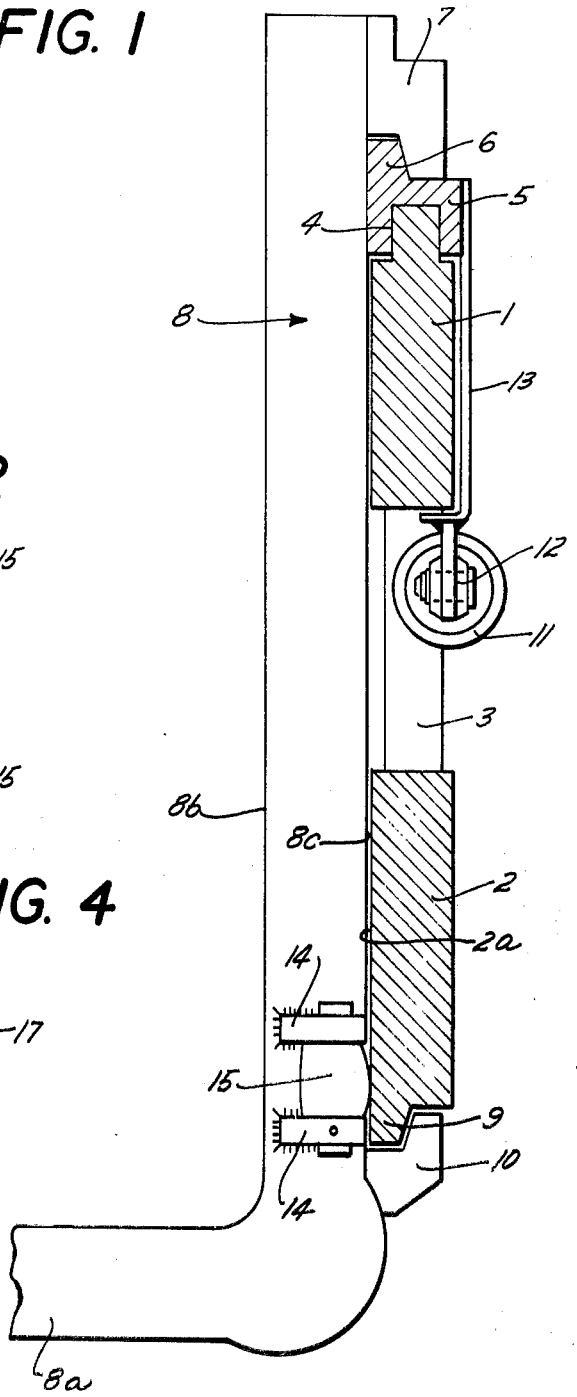
FIG. 1 is a vertical section through a portion of the lateral-shift device of a fork-lift vehicle according to the invention.
Figure 10:
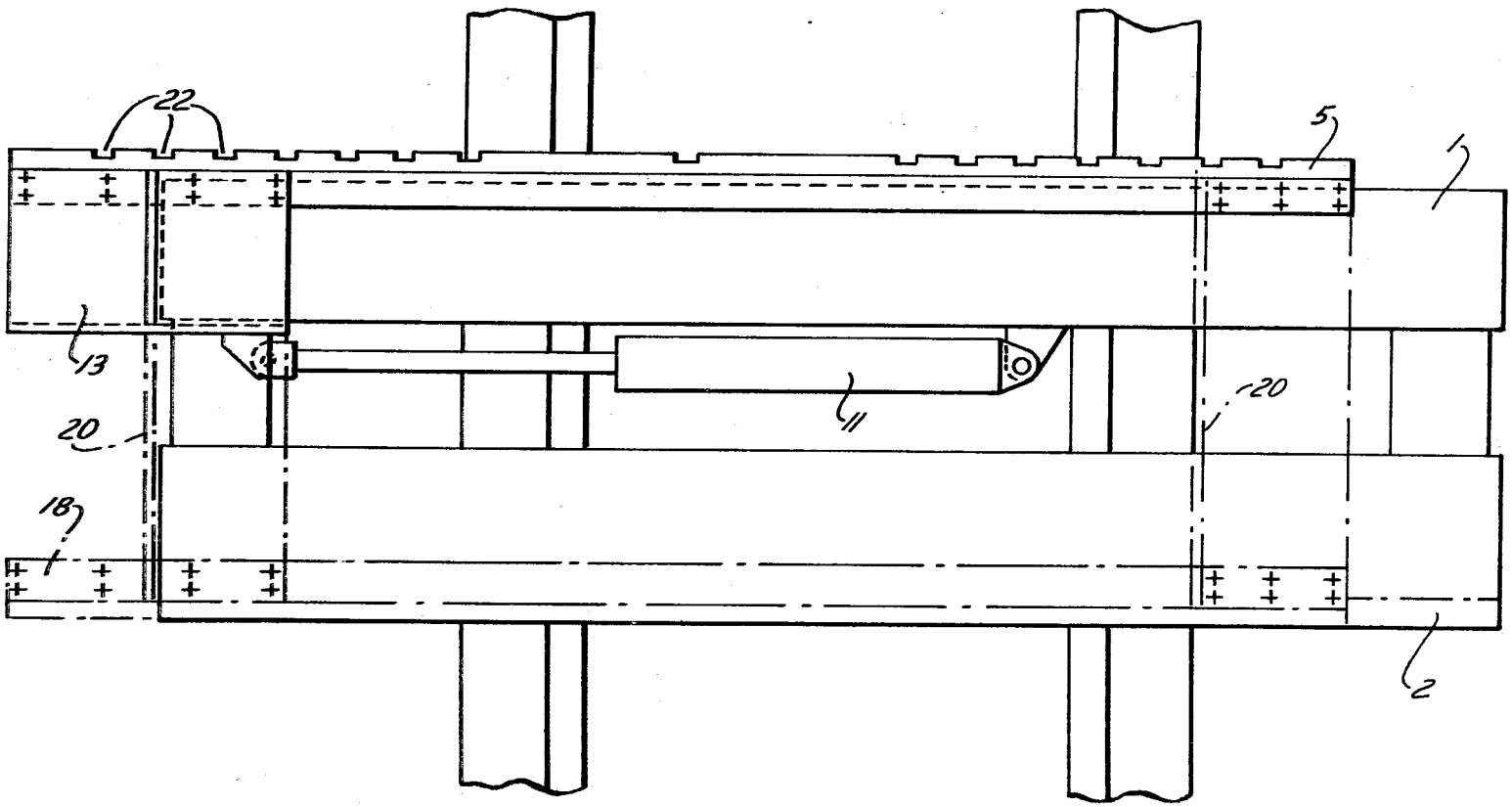
FIG. 10 is a front-elevational view of still another lateral shift device having the actuating cylinder located at an intermediate location in the height of the device.

The embodiment of FIG. 7 differs from that of FIGS. 1, 5 and 10 in that the actuating cylinder 25 is here disposed above the slide block 5 and hence above the upstanding portion 8*b* of the fork 8 and the guide bars 1 and 2. The connecting bar 27 between the piston rod 26 and the slide block 5 may be formed from a first portion 27*a* lying in a vertical plane and joined to the connecting rod 26, a second portion 27*b* lying in a vertical plane and connected to the slide block 27 and an inclined portion 27*c* connecting the first and second portions and providing a lateral offset *d* whereby the axis A of the cylinder may be disposed directly above the remainder of the lateral-shift assemblies 1, 2, 5, 18 etc. In general, in the embodiments disclosed in FIGS. 1, 5, 7, and 10, the axis and hence a major part of the cylinder lies between a pair of planes (shown for the embodiment of FIG. 7) which are represented at $P_1$ and $P_2$ and define the vertical outlines of the lateral shift assembly.

A similar embodiment is shown in FIG. 9 wherein, however, the slide block 5 is shown to cooperate with a pawl 23 as previously described. Here too the slide block is connected by an arm 27 with the piston rod 26 of the cylinder 25 and has a lateral offset sufficient to clear the pivot 21 of this pawl. The system otherwise operates as described in connection with FIG. 6.

Figure 11:
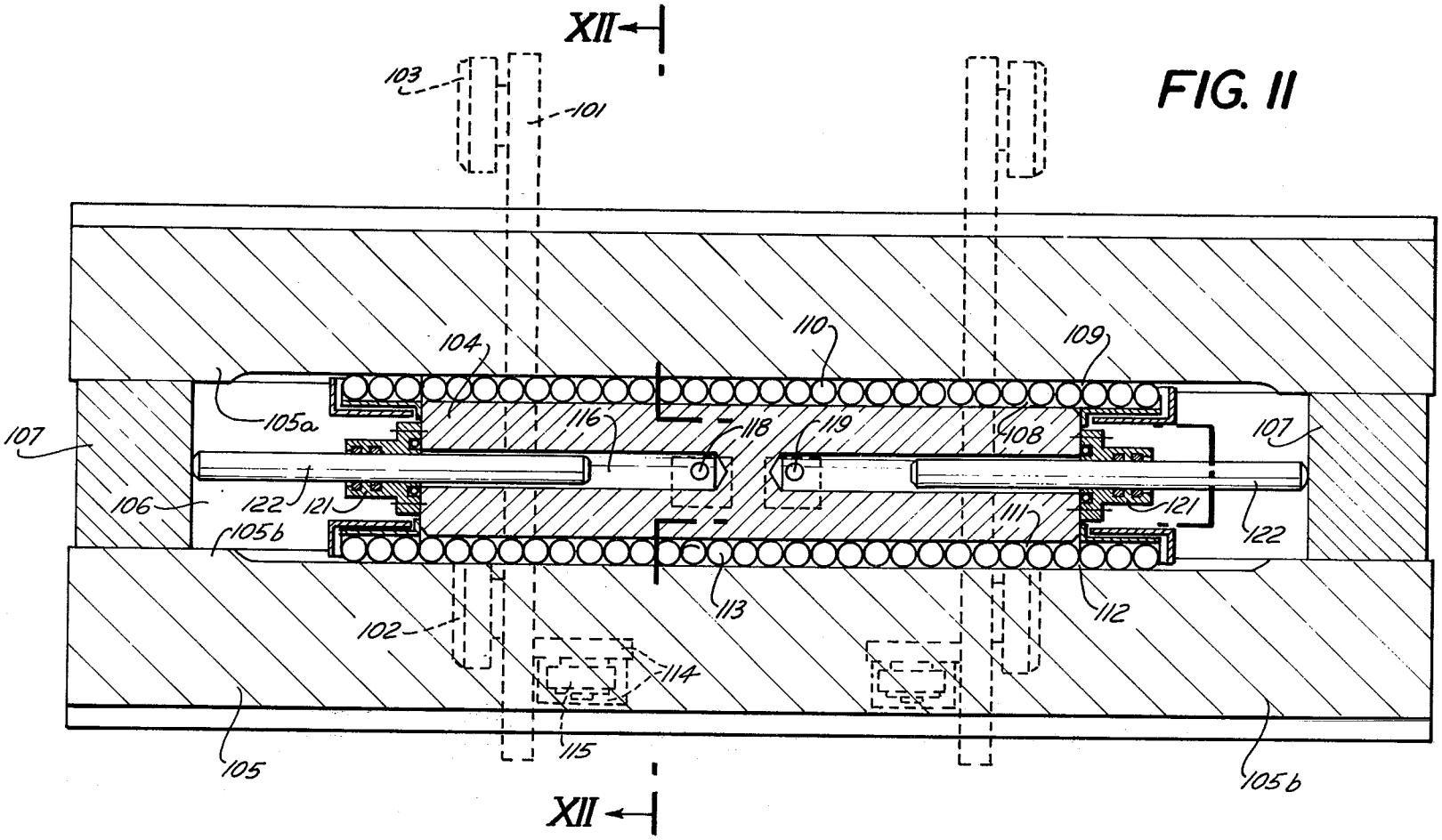
FIG. 11 is a section taken in a plane parallel to the front of the lifting frame (line XI—XI of FIG. 12) through a lateral shift arrangement according to the present invention.
Figure 13:
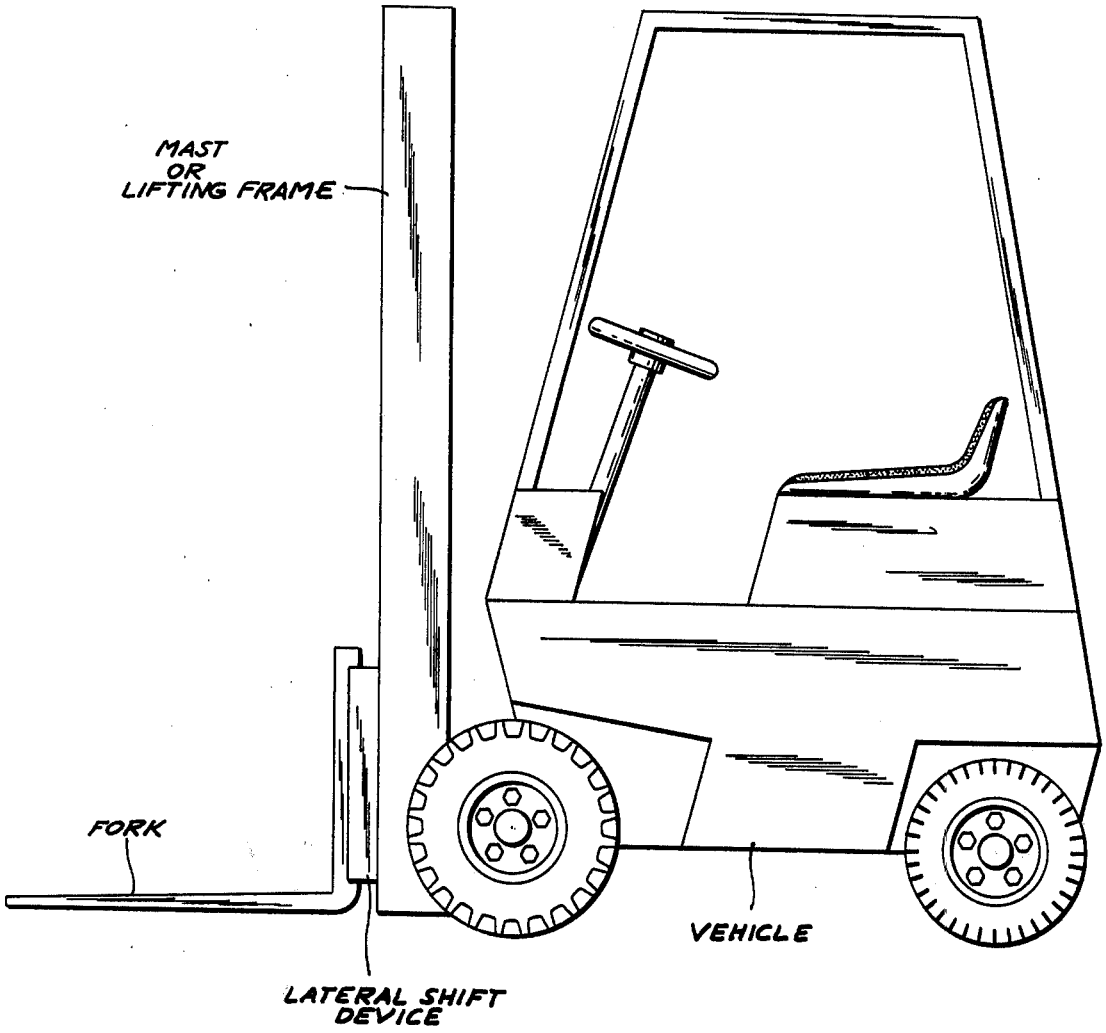
FIG. 13 shows a fork-lift truck which has the lateral shift device.

FIGS. 11 and 12 illustrate an embodiment of the invention in which the lifting carriage 101 is vertically shiftable upon a lifting frame which has not been illustrated but may be of the type described in the aforementioned copending application, the carriage 101 being guided upon the lifting frame by upper and lower rollers 102 and 103.

In the plane in which a rigid fork carrier is normally mounted upon the carriage, the invention provides an upper support member 104 to which the fork carrier is affixed. The upper member 104 is formed with a guide channel 108 of semi-cylindrical configuration in which pawls 110 are received to act as low-friction linear bearing members. The lower portion of member 104 is formed with a downwardly open channel 111 receiving the pawls 113.

As noted, member 104 is formed upon and is rigid with the vertically movable carriage 101. The fork (not shown) is mounted upon a rigid frame 105 which comprises upper and lower members 105*a* and 105*b* connected at their ends by webs 107 to define an opening 106 receiving the fluid responsive device for shifting the frame 105. The edges 105*a* and 105*b*′ of the upper and lower members 105*a* and 105*b* defining the opening 106, are formed with channels of cylindrical-segment cross-section receiving the pawls 110 and 113 to form linear races therefor. The channels have been indicated at 109 and 112 in FIG. 12.

The carriage 101 is also provided with recesses 114 in which rollers 115 are journaled about vertical axes to bear upon the rear face 126 of the lower member 105*b*. Of course the rollers may be mounted on the lower bar to bear upon the front face of the carriage.

The supporting body 104 is provided with a pair of horizontally extending bores 116 and 117, each connected by a passage 118, 119 to a respective hydraulic line 120. The bores 116 and 117 are closed at their opposite extremities by packing covers 121 and sealingly receive respective pistons 122 bearing against the webs 107.

The hydraulic lines 120 are connected to a valve whereby one may be pressurized while the other is drained and vice versa so that the pistons 122 can shift the frame 105 to the left or to the right as desired.

The face 104*a* of the support member 104 can be flush with the face 105′ of the fork carrying frame or recessed inwardly (to the right in FIG. 12) therefrom to avoid contact of goods carried by the fork or fork itself with the support member 104 and wear of this member as the frame is shifted to the right or to the left.

It will be apparent from FIGS. 11 and 12 that the system is highly versatile in that the forks 8 may be attached to the pawls 23 along the upper and lower formations 105″ of the frame as described in connection with, say, FIGS. 1 and 6, while the spacing between the members 105*a* and 105*b* of the frame may be varied by inserting webs 107 of different lengths. Rollers 115 may bear upon rails or especially formed of the support frame 105 and it is possible to connect the passages 118 and 119 to the vertically shiftable carriage without flexible tubing. The races 108, 109 and 111, 113 may have whatever configuration is necessary for most effective force distribution and can be designed, as illustrated, to permit some degree of filt of the shifting device out of the vertical plane without binding.

We claim:

1. In a fork-lift vehicle having a lifting frame, a fork carrier vertically shiftable on said frame, and a fork member having a pair of forwardly-extending prongs mounted on said carrier, the improvement which comprises a lateral-displacement device on said carrier for displacing said member horizontally relative to said frame, said carrier comprising a flat horizontally-extending upper bar, a flat horizontally-extending lower bar spaced from and parallel to said upper bar, and vertical struts at opposite ends of said bars rigidly connecting them together, said bars and said struts framing a horizontally elongated window, said bars having forward and rearward facial planes, said device lying substantially completely between said planes and comprising a flat, rectangular section elongated body shorter than said window and disposed between said bars and spaced from said struts within said window, said body having a front face lying in said forward facial plane, said body being formed with a pair of oppositely-extending horizontally aligned cylinder bores each opening at a respective end of said body opposite a respective strut and terminating close to the center of said body, and a respective piston pin slidably received in each bore and bearing upon the respective strut upon fluid pressurization of the respective bore to displace said carrier horizontally, said body being mounted upon said frame, a linear array of ball bearings disposed between each of said bars and a respective side of said body for guiding said bars on said body, said upper bar being formed with a riding block complementarily engaging said rail and shiftable thereon, and pawl-and-notch means between said rail and said member enabling selective positioning of said member horizontally along said rail.

2. The improvement defined in claim 1, further comprising support rollers between at least the lower bar and said frame.

3. The improvement defined in claim 2 wherein each of said support rollers is journaled in said lifting frame and bears upon the rear face of said lower bar.

* * * * *